US012416145B2

(12) United States Patent
Swett

(10) Patent No.: US 12,416,145 B2
(45) Date of Patent: Sep. 16, 2025

(54) SYSTEM FOR VENTING ODORS FROM A TOILET BOWL

(71) Applicant: Thomas R. Swett, Sedro-Woolly, WA (US)

(72) Inventor: Thomas R. Swett, Sedro-Woolly, WA (US)

( * ) Notice: Subject to any disclaimer, the term of this patent is extended or adjusted under 35 U.S.C. 154(b) by 280 days.

(21) Appl. No.: 18/167,147

(22) Filed: Feb. 10, 2023

(65) Prior Publication Data

US 2023/0257983 A1 Aug. 17, 2023

Related U.S. Application Data

(60) Provisional application No. 63/309,052, filed on Feb. 11, 2022.

(51) Int. Cl.
*E03D 9/052* (2006.01)
*E03D 9/05* (2006.01)

(52) U.S. Cl.
CPC ..... *E03D 9/052* (2013.01); *E03D 9/05* (2013.01)

(58) Field of Classification Search
CPC .. E03D 9/052; E03D 9/05; E03D 9/04; A47K 13/307; A47K 13/30; F16L 3/085; F16L 3/105; F16L 41/04; F16L 41/06; F16L 41/12
USPC ..... 285/197, 924; 4/209 R
See application file for complete search history.

(56) References Cited

U.S. PATENT DOCUMENTS 3,533,111 A 10/1970 Bowman et al.
3,703,010 A * 11/1972 Russell ..... E03D 9/052 4/216
3,938,201 A * 2/1976 McGrew ..... E03D 9/052 4/213
5,016,294 A * 5/1991 Canovas ..... E03D 9/052 4/209 R
5,170,512 A 12/1992 Prisco
5,694,972 A * 12/1997 King ..... A01G 25/023 285/423
5,991,934 A 11/1999 Hsu
6,016,576 A 1/2000 Happe
6,019,862 A 2/2000 Cardwell et al.
(Continued)

FOREIGN PATENT DOCUMENTS

WO WO-2016189517 A1 * 12/2016
WO WO-2021122123 A1 * 6/2021 ..... A61M 1/06

*Primary Examiner* — Paul R Durand
*Assistant Examiner* — Michael C Patterson
(74) *Attorney, Agent, or Firm* — FisherBroyles, LLP; Susan M. Oiler

(57) ABSTRACT

Systems for venting odors from a toilet bowl include a toilet having a bowl defining a headspace and having a plumbing connection to a vent stack, a plurality of micro-vacuum pumps in fluid communication with the headspace of the bowl of the toilet and in fluid communication with the vent stack. The fluid communication with the vent stack can include a saddle configured to mount to the vent stack. The saddle has an elongate seat that includes a plurality of tubular taps extending therethrough at an orientation transverse to a longitudinal axis of the saddle, and an annular adjustable clamp for attaching the elongate seat to the vent stack. When the saddle is mounted to the vent stack, each of the tubular taps creates fluid communication between the interior of the vent stack and one each of the plurality of micro-vacuum pumps.

20 Claims, 9 Drawing Sheets

(56) References Cited

U.S. PATENT DOCUMENTS

| | | | | |
|---|---|---|---|---|
| 6,237,163 | B1 * | 5/2001 | Guzzo | E03D 9/05 4/352 |
| 8,239,973 | B1 * | 8/2012 | Character | A47K 13/307 4/219 |
| 9,481,990 | B2 | 11/2016 | Sollami | |
| 9,532,687 | B2 | 1/2017 | Sollami | |
| 9,808,132 | B2 * | 11/2017 | Smith | A47K 13/307 |
| 9,877,623 | B2 | 1/2018 | Sollami | |
| 9,924,841 | B1 | 3/2018 | Luquin | |
| 2003/0070212 | A1 | 4/2003 | Brodhead | |
| 2005/0138720 | A1 * | 6/2005 | Shim | E03D 9/052 4/213 |
| 2008/0040842 | A1 * | 2/2008 | Sanabria | A47K 13/307 4/213 |
| 2011/0047686 | A1 * | 3/2011 | Moore | E03D 9/052 4/213 |
| 2013/0263366 | A1 * | 10/2013 | Prete | A47K 13/307 4/209 R |

* cited by examiner

FIG. 1
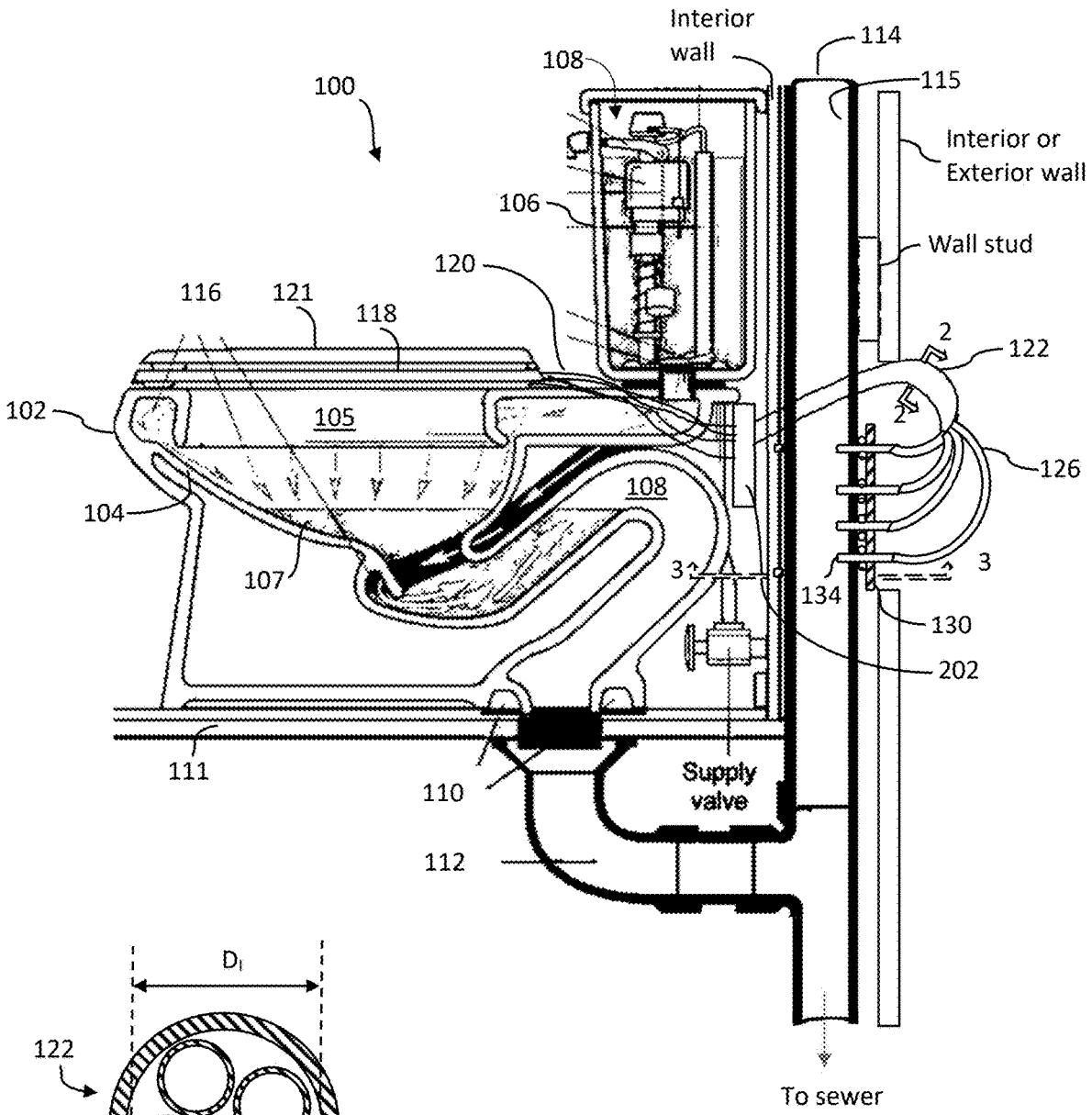
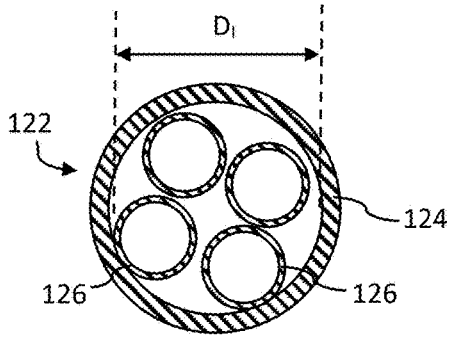
FIG. 2

FIG. 3
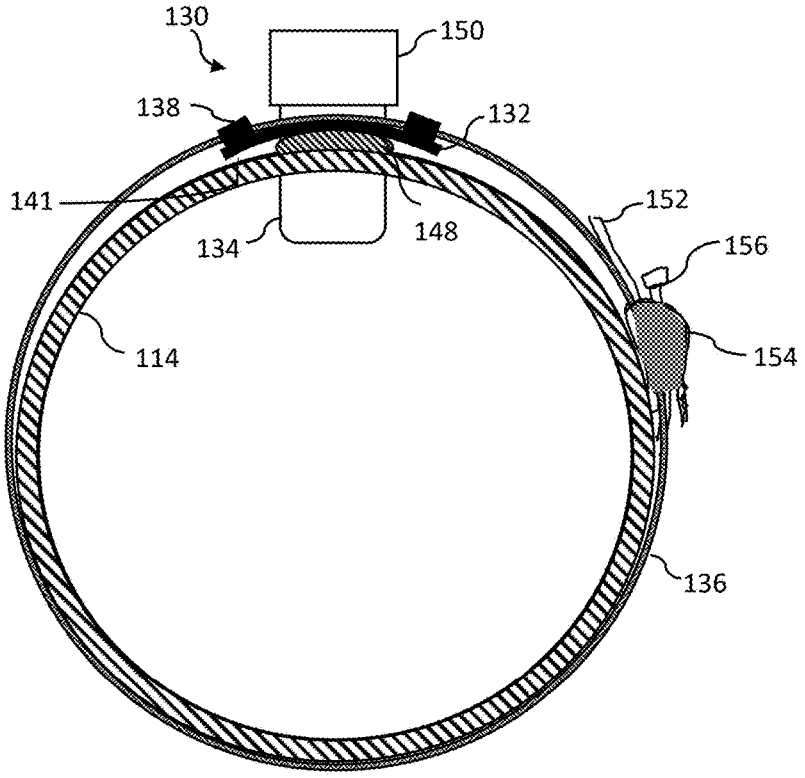
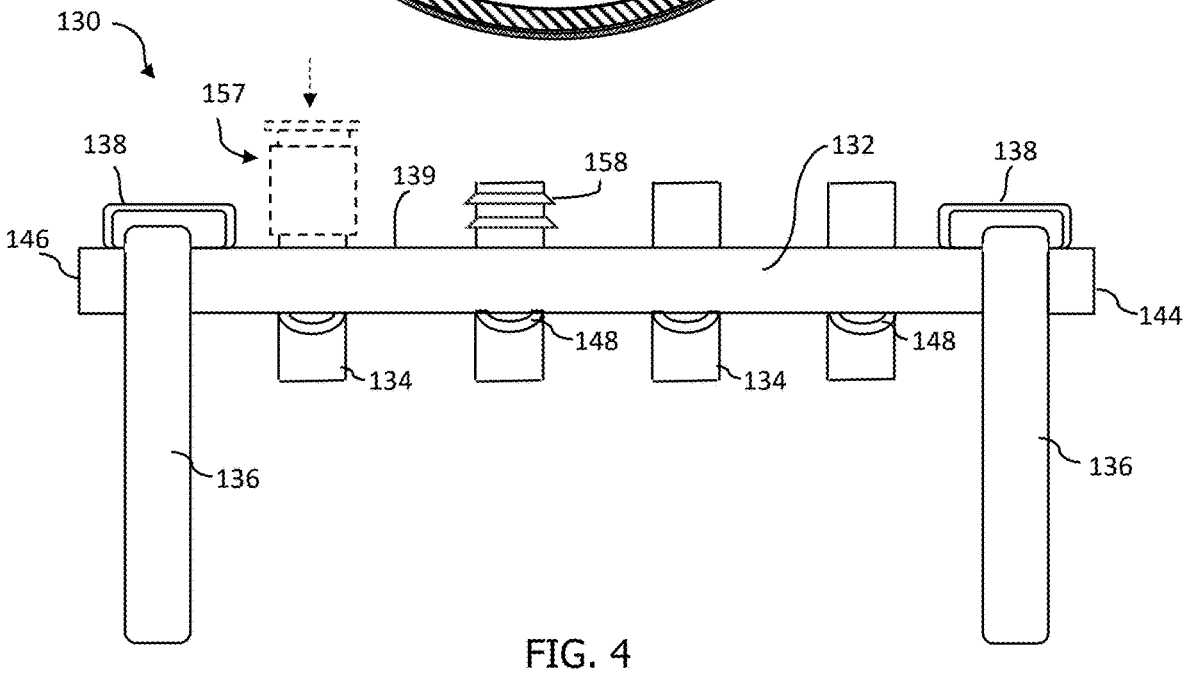
FIG. 4

FIG. 6
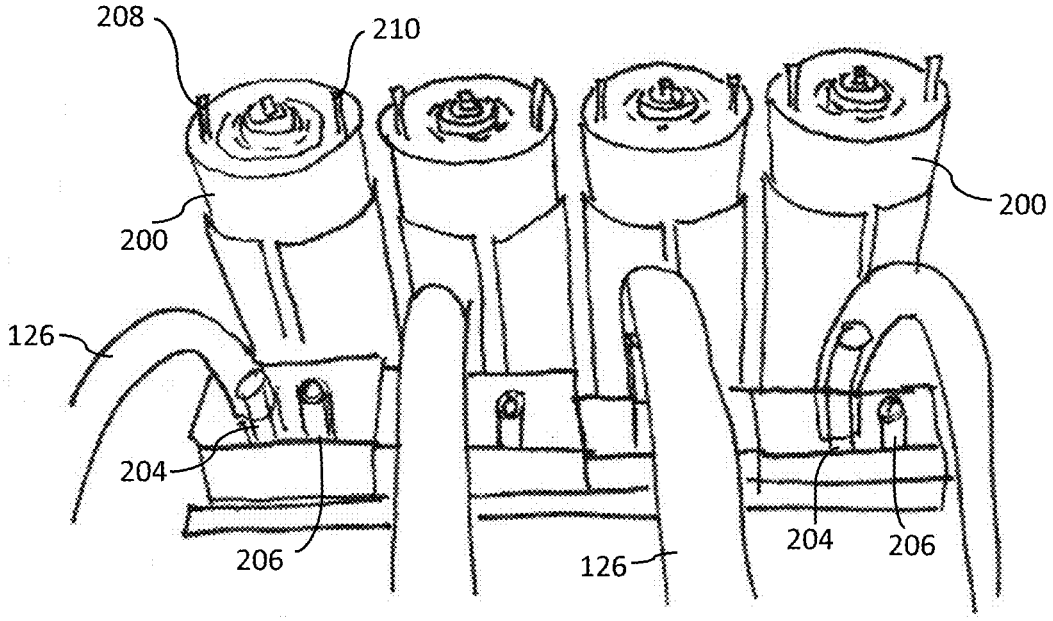
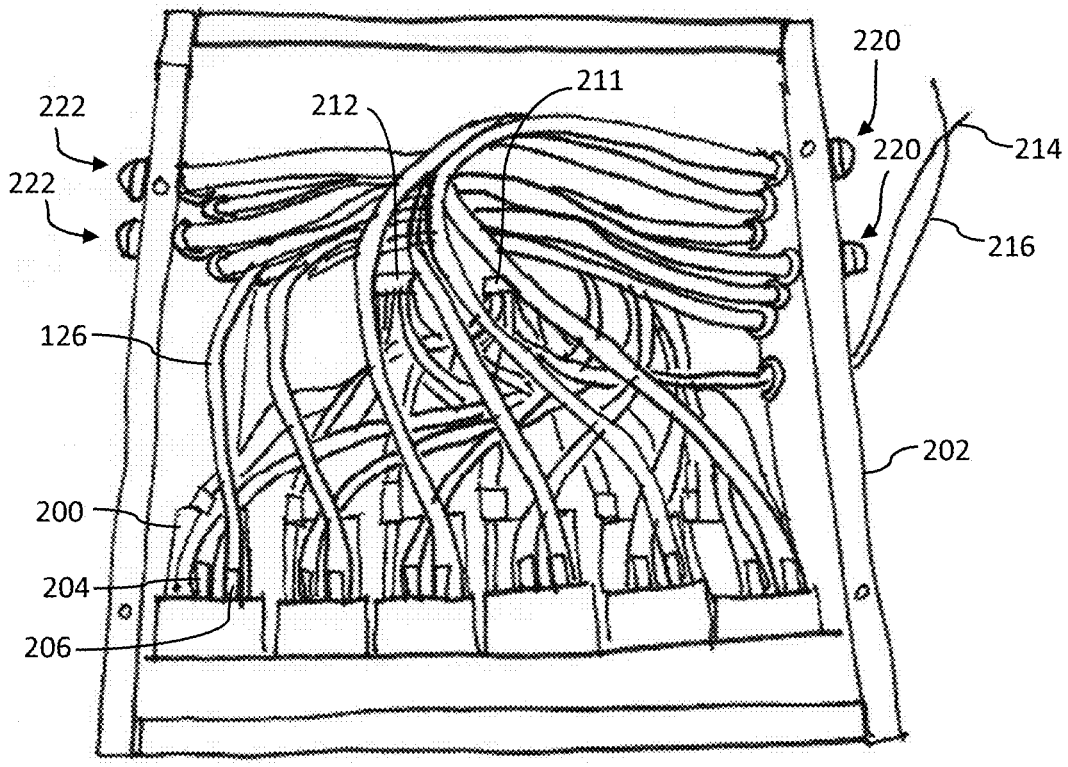
FIG. 7

FIG. 8
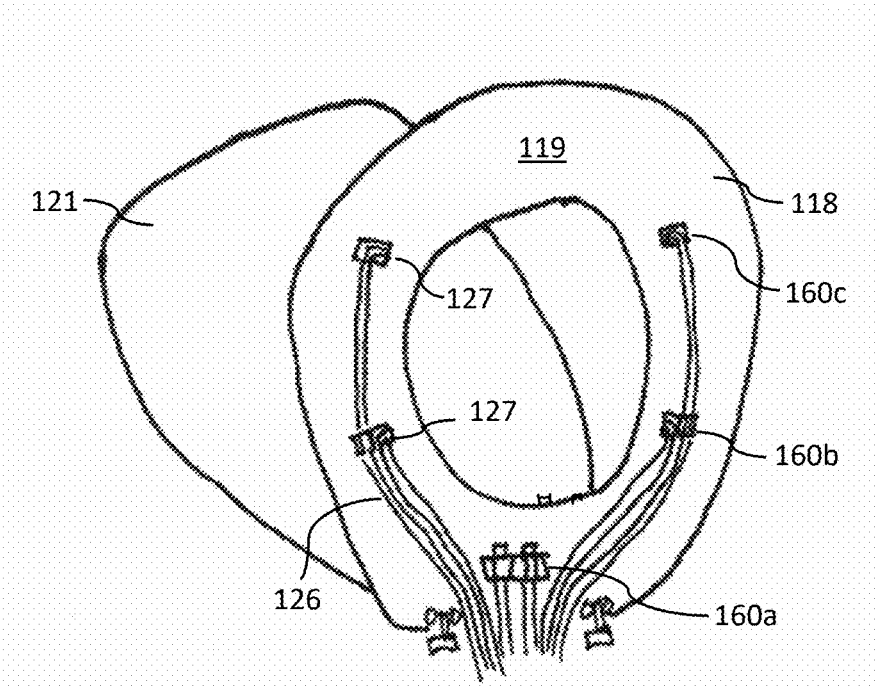
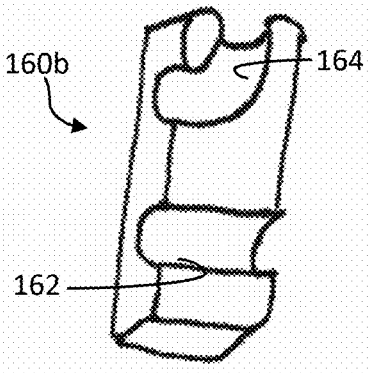
FIG. 9
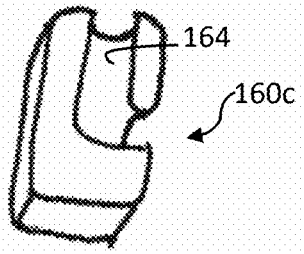
FIG. 10
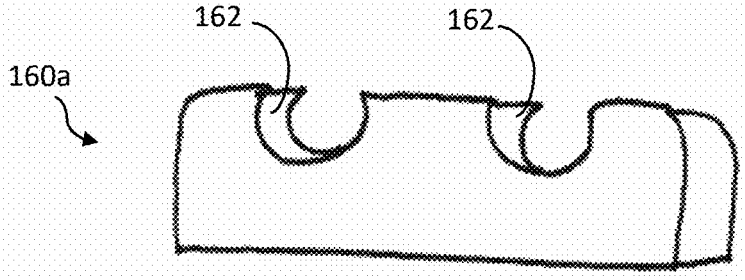
FIG. 11

SYSTEM FOR VENTING ODORS FROM A TOILET BOWL

RELATED APPLICATIONS

This application claims the benefit of U.S. Provisional Application No. 63/309,052, filed on Feb. 11, 2022, the entirety of which is incorporated herein by reference.

TECHNICAL FIELD

This application relates to a system for venting odors from a toilet bowl, more particularly a system having a plurality of micro-vacuum pumps in fluid communication with the toilet bowl that pump odors to a vent stack. The system can include a saddle seated on the vent stack with an exhaust tap per micro-vacuum pump inserted into the vent stack.

BACKGROUND

Numerous devices have been proposed for the removal or neutralization of odors generated in the normal use of a toilet. Many current art toilets depend on a ceiling ventilation exhaust fan to remove odors which originate in the toilet. This process is inefficient and ineffective as the gases enter the room before being exhausted. Others have tried various combinations of motors and fans to remove odors from the toilet bowl, through the toilet seat, or through the room, but improvements thereover are still needed. Fans for bathrooms are designed to move a large volume of air and are traditionally configured to remove moisture from bathrooms to aid in the prevention of mold growth.

A vent stack, also called a plumbing vent, is typically present in the construction of a building to filter gasses away from a home or business and is a crucial component in regulating air pressure in indoor plumbing. The vent stack typically runs inside of the walls of a structure and exits out through the roof. Most notably, vent stacks are used to vent sewer gas and odors as well as to create an air supply to allow the drains and toilets to operate smoothly. The vent stack is typically a vertical or nearly vertical pipe that is connected to the trap(s) of plumbing fixtures in such a manner as to ventilate them and prevent the water seal from being siphoned out of the trap(s).

There is a need to remove the odors from a toilet efficiently without the use of the traditional exhaust fan, thereby providing a system having compact components and utilizing the existing vent stack.

BRIEF DESCRIPTION OF THE DRAWINGS

FIG. 1 is a cross-section through a standard toilet showing its connection to the sewer, including a vent stack having a saddle seated thereon that provides fluid communication between the toilet bowl and the vent stack via a plurality of micro-vacuum pumps.

FIG. 2 is a transverse cross-section along line 2-2 in FIG. 1 through one embodiment of a conduit between the micro-vacuum pumps and the saddle.

FIG. 3 is a transverse cross-section along line 3-3 in FIG. 1 through the vent stack and saddle.

FIG. 4 is a left-side view of one embodiment of the saddle.

FIG. 6 is a photograph of four micro-vacuum pumps and their respective flexible tubing for one embodiment of the mechanism inside a pump housing.

FIG. 7 is a photograph of an embodiment having six micro-vacuum pumps seated in an operative arrangement inside a housing.

FIG. 8 is a bottom perspective view of a toilet seat showing connectors for a plurality of flexible tubing segments.

FIG. 9 is an enlarged perspective view of one of the spacers on the toilet seat.

FIG. 10 is an enlarged perspective view of another of the spacers on the toilet seat.

FIG. 11 is an enlarged perspective view of a third of the spacers on the toilet seat.

DETAILED DESCRIPTION

Figure 5:
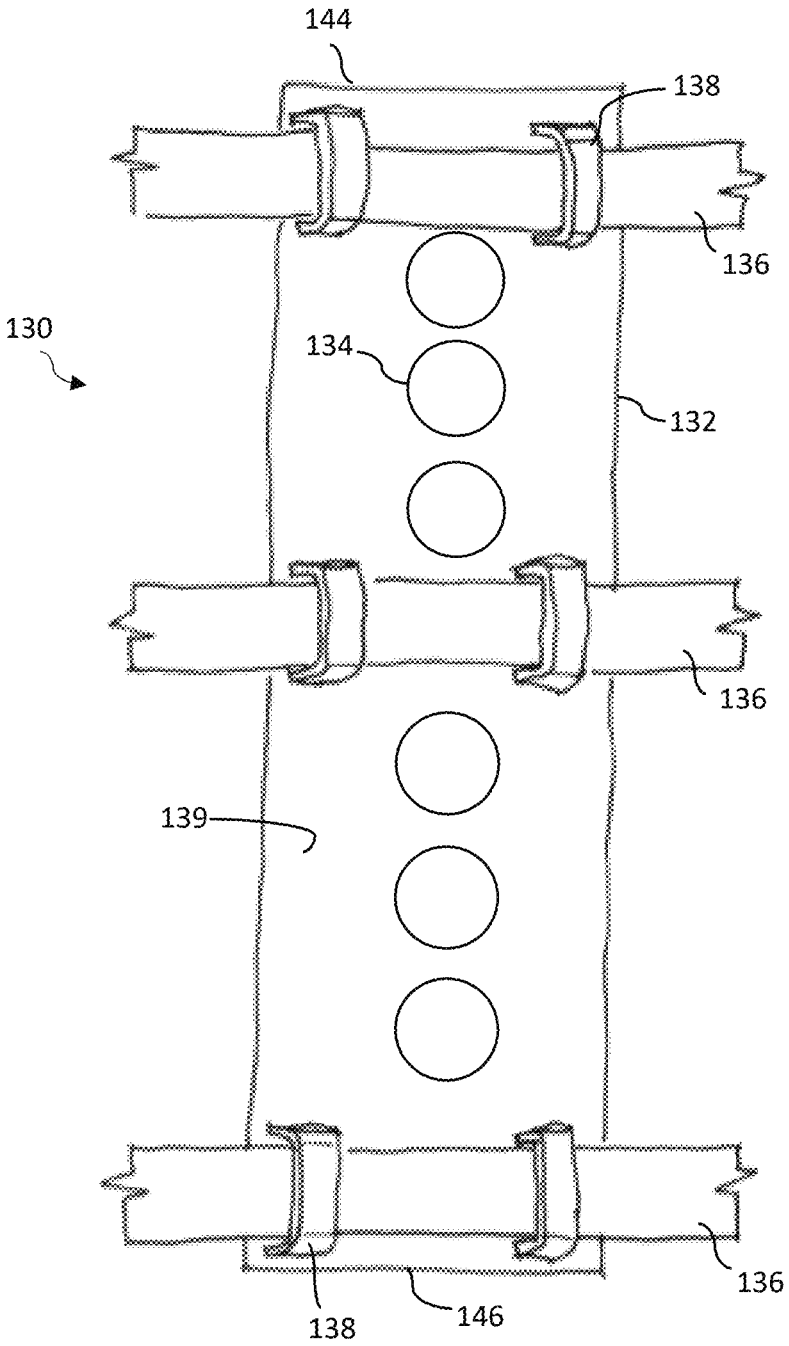
FIG. 5 is a top view of an embodiment of the saddle that has six exhaust taps and annular clamps for connecting the saddle to a vent stack.

The following detailed description will illustrate the general principles of the invention, examples of which are additionally illustrated in the accompanying drawings. In the drawings, like reference numbers indicate identical or functionally similar elements.

Referring to FIG. 1, a system 100 for venting odors from a toilet bowl 104 of a toilet 102 is shown. The toilet 102 has a tank 106 housing a flushing mechanism 108 in fluid communication with the bowl 104 and a trap 108 connected to a water-tight seal 110, such as a wax ring, adjoining the toilet 102 to the floor 111 and to the toilet plumbing conduit 112 that is in fluid communication with the sewer and a vent stack 114. The toilet bowl 104 defines a headspace 105 above the water 107 therein and includes a plurality of flush passages 116. The toilet 102 has a toilet seat 118 that has a lid 121 hingedly connected to the toilet seat. The system 100 has a plurality of micro-vacuum pumps 200 (see FIGS. 6 and 7) enclosed in housing 202 that are in fluid communication with the headspace 105 of the toilet bowl 104 via first tubing 120 and are in fluid communication with the vent stack 114 via second tubing 122. The second tubing 122 can house a plurality of smaller diameter tubes 126, which are each individually in fluid communication with the vent stack 114. In one embodiment, each smaller diameter tube 126 is attached to a tap that is transecting a wall of the vent stack 114, thereby providing fluid communication with the interior of the vent stack. In another embodiment, a saddle 130 is present that is configured to be seated on the vent stack and to provide the means for fluid communication with the vent stack 114.

Referring to FIG. 2, at least the second tubing 122, but also optionally the first tubing 120, has a primary tube 124 having an internal diameter Di sufficient to have a plurality of smaller diameter tubing 126 running the length inside the primary tube. The plurality of smaller diameter tubing 126 are at least equivalent in number to the number of the plurality of micro-vacuum pumps 200.

Referring now to FIGS. 1 and 3-5, the saddle 130 has an elongate seat 132 having a plurality of tubular taps 134 passing through the elongate seat 132 at an orientation configured to tap into the vent stack 114 and has a means for attaching the elongate seat 136 to the vent stack. When the saddle 130 is mounted to the vent stack 114, the plurality of tubular taps 134 create fluid communication between an interior 115 of the vent stack and one each of the plurality of micro-vacuum pumps 200. In one embodiment, the plurality of tubular taps 134 are equivalent in number to the number of the plurality of micro-vacuum pumps 200. In another embodiment, the plurality of tubular taps 134 is fewer in number than the number of the plurality of micro-vacuum pumps 200. The elongate seat 132 can have a concave underside 141 as best seen in FIG. 3. The concave underside 141 can have a contour that mates to the exterior of the vent stack 114. In one embodiment, the concave underside 141 extends at least ten degrees along the circumference of the vent stack 114. In one embodiment, the concave underside extends between 10 degrees to 180 degrees along the circumference of the vent stack 114, more preferably between 10 degrees to 90 degrees.

Still referring to FIGS. 3-5, in one embodiment, the saddle 130 includes a plurality of loops 138 protruding out from a top surface 139 of the elongate seat 132 through which the means for attaching the elongate seat 136 to the vent stack is fed. As seen in FIG. 4, when the number of the plurality of taps 134 is four or less, the plurality of loops 138 can be present as two sets, one each proximate the first and second ends 144, 146 of the elongate seat 132. In an embodiment, such as FIG. 5, with more than four taps 134, the plurality of loops can be present as three or more sets, one set at each end 144, 146 of the elongate seat 132 and the remainder spaced therebetween in even or uneven increments. In all embodiments, as best seen in FIGS. 3 and 4, the saddle can have a sealing member 148 seated about each of the plurality of exhaust taps 134. The sealing member can be a single integral body having a plurality of bores therethrough seated against the underside 141 of the elongate seat 132, where one each of the plurality of bores corresponds to one each of the plurality of exhaust taps 134. In another embodiment, the sealing member 148 is an O-ring seal, V-ring seal, X-ring seal, or any other suitable annular sealing ring, arranged as one each per tap 148. The sealing member 148 can be a rubber washer or a silicone seal.

Referring to FIG. 3, each of the plurality of exhaust taps 134 can have a quick connect fitting 150 for connection to one each, respectively, of the plurality of smaller diameter tubing 126. The quick connect fitting may be a slide lock fitting 157, a compression fitting, a barbed nipple 158, or other commercially available quick connector.

Figure 15:
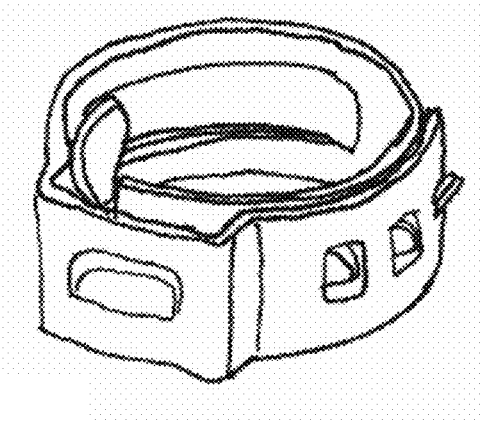
FIG. 15 is an example of a SHARKBITE™ brand clamp ring.
Figure 16:
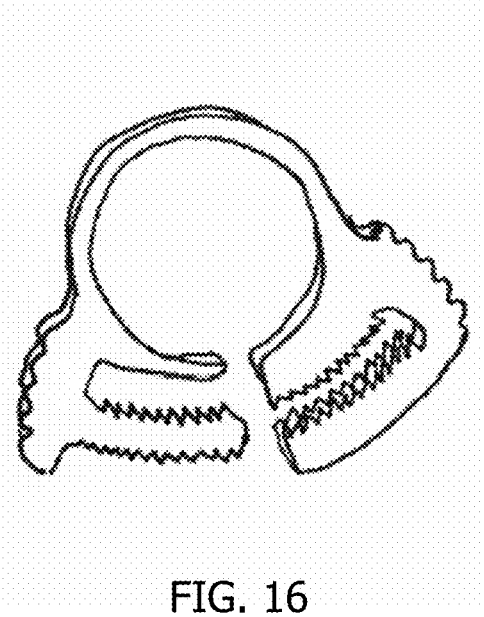
FIG. 16 is an example of a HERBIE CLIP® doubled bonded plastic hose clamp

Still referring to FIG. 3, the means for attaching the elongate seat 136 to the vent stack 114 can be an annular adjustable clamp, which has an end 152 fed through a tightening fitting 154 operable by a screw 156 (known commercially as a worm gear clamp). In one embodiment, the annular adjustable clamp is a SharkBite™ clamp ring (FIG. 15), a t-bolt hose clamp, or a Herbie Clip® double bonded plastic hose clamp (FIG. 16). In other embodiments, the means for attaching the elongate seat to the vent stack can be a zip tie, an adhesive, a pipe clamp, banded strapping, ratchet straps, wire, straps having hook-and-loop fasteners.

Turning now to FIGS. 1, 6, and 7, the plurality of micro-vacuum pumps 200 which are each in fluid communication with the headspace 105 of the toilet bowl 104 each have two electrical connection terminals 208, 210 and a first pump port 204 and a second pump port 206. Each of the ports 204, 206 are connectable to a segment of tubing 126. The port to tubing connection can be a male-to-female connection or vice versa. The plurality of micro-vacuum pumps 200 can be seated in a housing 202 with the terminals 208, 210 of each electrically wired to a panel (a power panel 211 and a ground panel 212) or electrical connector such that a power positive 214 and a single ground wire 216 exits the housing 202 for connection to a power source. Each micro-vacuum pump 200 can be rated at 40 liters per minute (lpm) or 60 1 μm and can be a 12 volt, 1 amp, 12 Watt pump within individual, independent vacuum ports 204, 206. The plurality of micro-vacuum pumps 200 are enclosed in housing 202, which has dual connectors 220, 222 for each of the plurality of micro-vacuum pumps. Each of the dual connectors 220,222 is connectable to the tubing 126.

Figure 12:
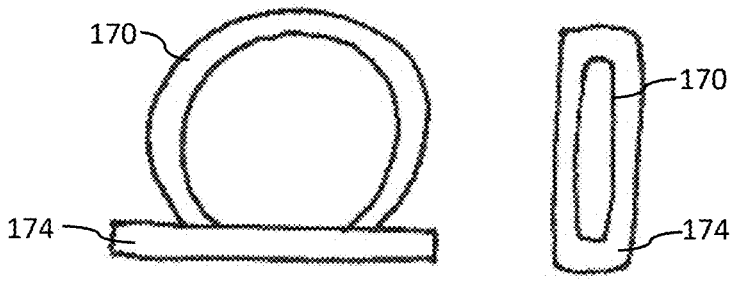
FIG. 12 is a first embodiment of a clip for holding the flexible tubing between spacers on the toilet seat.
Figure 13:
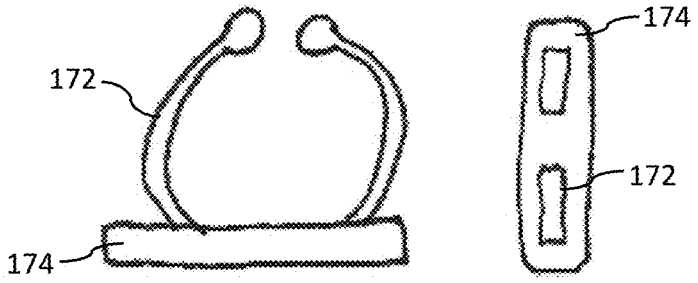
FIG. 13 is a second embodiment of a clip for holding the flexible tubing between spacers on the toilet seat.
Figure 14:
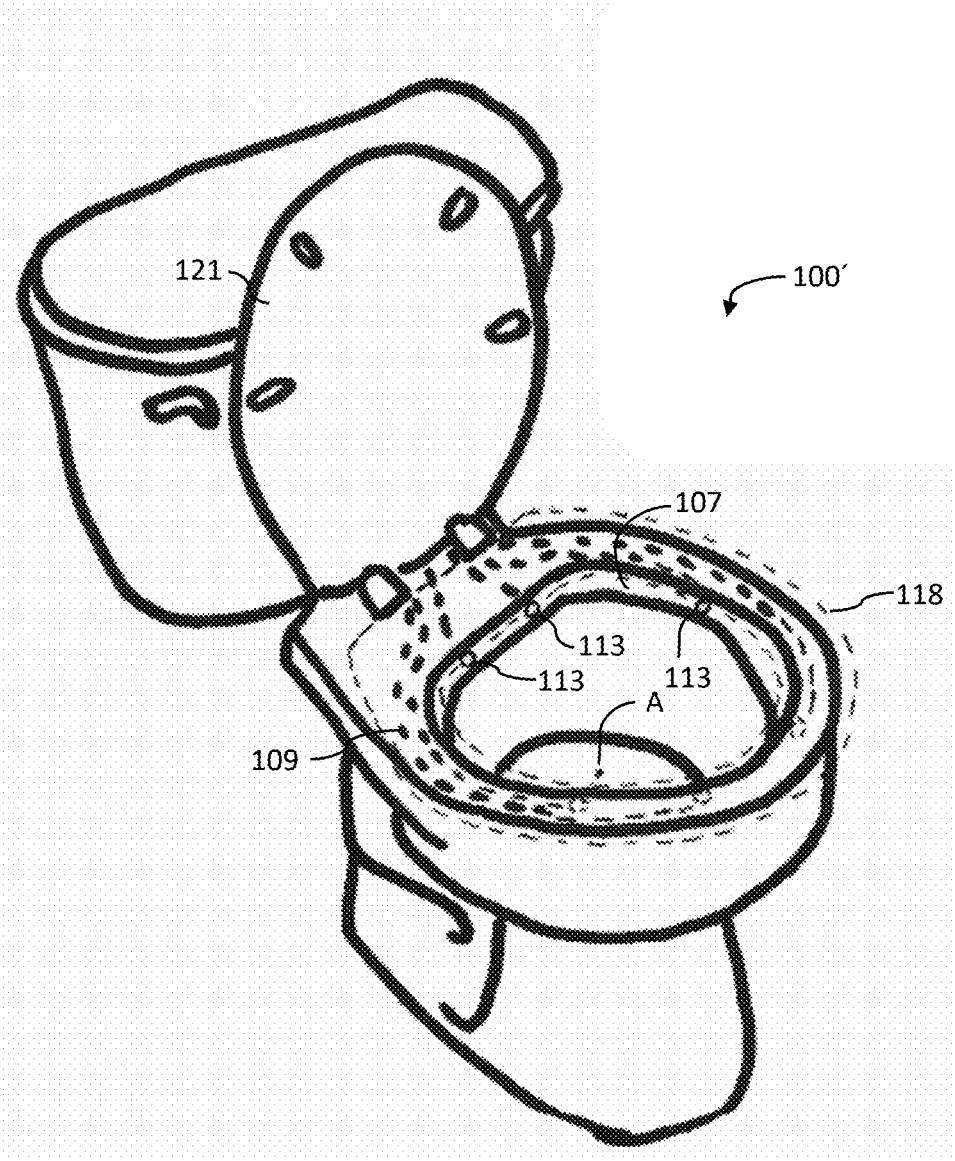
FIG. 14 is an alternate embodiment in which tubing or conduits are within the toilet and terminate facing the bowl rather than being in the seat.

The plurality of micro-vacuum pumps 200 are each in fluid communication with the headspace 105 of the toilet bowl 104 either via the seat, FIGS. 8-13, or through the bowl, FIG. 14. Turning first to FIGS. 8-13, the plurality of smaller diameter tubing 126, which is flexible tubing, typically ¼ in tubing, is run along the bottom surface 119 of the toilet seat 118 and has each open end 127 positioned to face radially inward toward a central axis A (labeled in FIG. 14) of the toilet bowl 104. The plurality of smaller diameter tubing 126 will usually be 4, 5, 6, 7, or 8 tubing segments, most often 4 or 6 tubing segments. As shown in FIG. 8, the tubing 126 can be mounted to the bottom surface 119 of the toilet seat via the seat spacers 160. The spacers may have different troughs 162, 164 recessed therein that each form a through-path to hold the tubing 126 as needed for proper orientation relative to the toilet bowl.

Starting most proximate the tank of the toilet, a first seat spacer 160*a* is generally centrally positioned at the rear of the seat proximate the hinges. Referring to FIG. 11, this first seat spacer 160*a* has a plurality of troughs 162 that are linear from rear to front to direct each tubing 126 seated therein toward the toilet bowl. Each trough 162 is C-shaped with a narrowed opening to retain the tubing therein, especially when the toilet seat is lifted. The illustrated embodiment has two troughs, but could have more, if more micro-vacuum pumps are used. Now with reference to FIGS. 8 and 9, moving around the circumference of the toilet seat toward the front, there is a second seat spacer 160*b* that has two troughs 162, 164 therein. The first trough 162 is a linear trough generally from rear to front and the second trough 164 is an elbow trough 164. The elbow trough 164 begins in the rear surface of the seat spacer and exits toward the toilet bowl. The elbow is generally a 90 degree bend. The toilet seat has at least two of the second seat spacer 160*b* that are mirror images of one another, one being positioned on the left half of the toilet seat and the other on the right half. At least two of a third seat spacer 160*c* are present, one each on the left half and the right half of the toilet seat, positioned as mirror images of one another. The third seat spacers 160*c* form the terminus of the tubing around the toilet bowl and have there an elbow trough 164. Here also, the elbow trough 164 begins in the rear surface of the third seat spacer 160*c* and exits toward the toilet bowl. The elbow trough 164 has the necessary bend angle to have the opening 127 of the tubing 126 facing the toilet bowl.

With reference to FIGS. 12 and 13, in addition to seat spacers 160, closed ring(s) 170 or open C-shaped clip(s) 172 can be mounted therebetween to hold the tubing 126 in place. The closed ring(s) 170 and open C-shaped clip(s) 172 have a base 174 for mounting the same to the bottom surface 199 of the toilet seat 118, such as by adhesive, screws, hook- and loop fasteners, etc. There can be one, two, three, etc., rings or clips per base as needed to hold the respective lengths of tubing in place between the spacers.

Referring now to FIG. 14, a porcelain toilet 100' is shown that was formed (cast) with internal vacuum flow channels 109 through the porcelain that terminate with air extraction ports 113 in the internal rim 107 of the toilet bowl 104. The internal vacuum flow channels 109 exit the toilet through the bottom, back or side of the toilet and have or were formed with a fitting for connection to tubing from the housing 202 for fluid communication with the plurality of micro-vacuum pumps 200. The internal vacuum flow channels 109 can be positioned in generally the same locations as the seat spacers described above—at least terminating in the rear of the toilet bowl and at least two in each of the left and right half portions of the toilet bowl. The air extraction ports 113 in the two halves are generally equally spaced from one another.

In embodiments where the toilets are plastic, such as those used in many recreational vehicles, the plastic toilet may be formed with internal vacuum flow channels, can have holes drilled therein and fitted with fittings for the connection of tubing, or can have tubing fed through such holes to terminate with an open end facing the toilet bowl.

Figure 17:
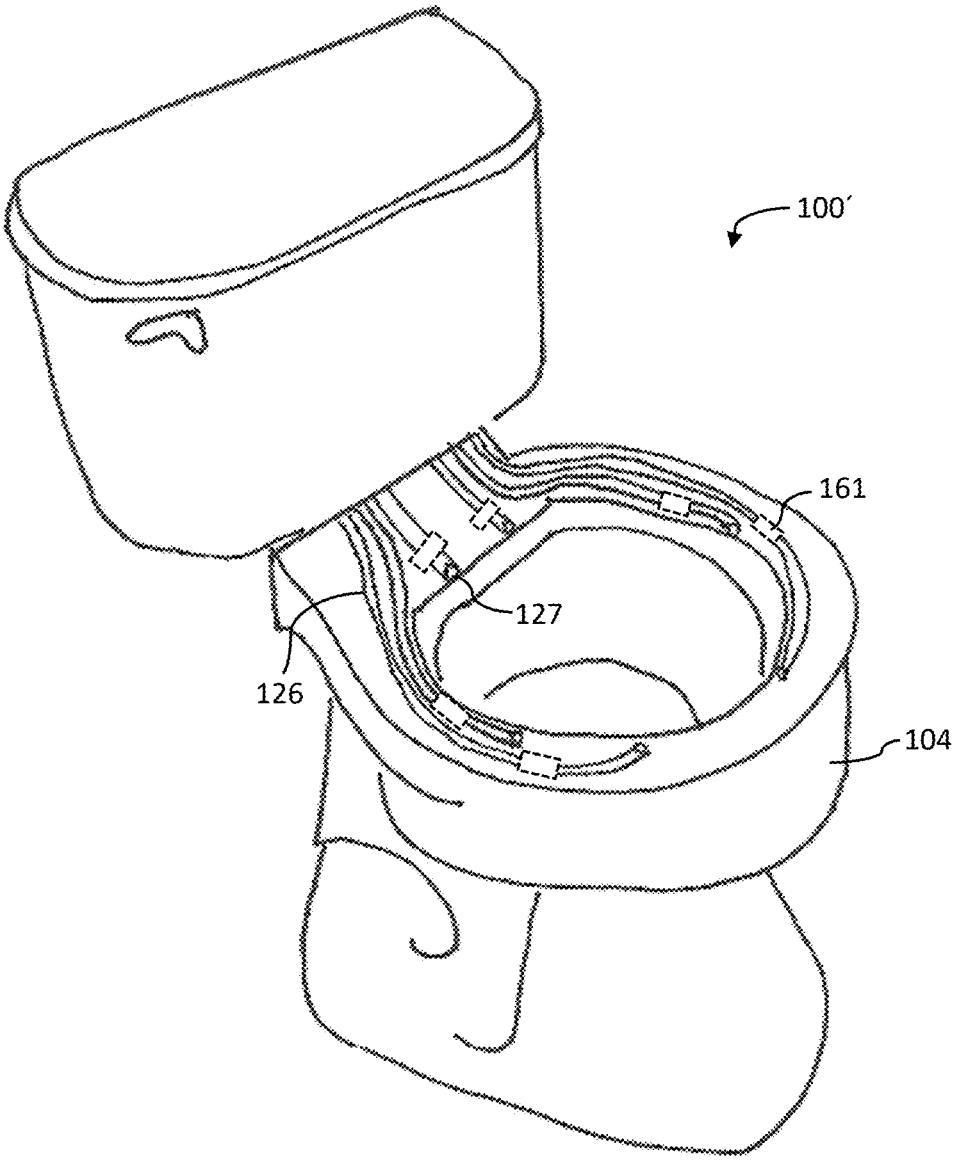
FIG. 17 is another alternate embodiment in which tubing is retrofitted to an existing toilet bowl.

In yet another embodiment, with reference to FIG. 17, existing toilets can be retrofitted with the system of FIG. 1 with a clamp 161 that clips to the rim of the toilet bowl that holds one or more segments of flexible tubing in the proper orientation for the open end to face the toilet bowl.

In operation, the micro-vacuum pumps can be configured to turn on when the toilet is flushed and to run for a predetermined period-of-time thereafter. In one embodiment, the period-of time is three minutes. In another embodiment, the period-of-time is five minutes. In yet another embodiment, the period-of-time is two minutes. In still another embodiment, the period-of-time is, three minutes. In one embodiment, the housing is wired to a switch such that the user of the bathroom can turn the micro-vacuum pumps one and off at will. In one embodiment, the housing is electrically wired to be plugged into an outlet. In another embodiment, the housing is electrically hard wired into the electrical system of the building or RV.

The components discussed herein can be provided in a kit. The kit may include the housing with the vacuum pumps wired and fluidly connected as described above, the saddle with all its component parts, tubing for connecting the housing to the exhaust taps of the saddle, and tubing to connect the housing to the toilet. In some embodiment, the toilet and/or the toilet seat may be included. The toilet seat can include the seat spacers as described herein that hold the tubing. In a different embodiment, the kit can include the clamps that mount to the toilet bowl to hold the tubing at the proper orientation for the open ends to be facing the toilet bowl.

The system disclosed herein provides efficient and effective removal of odors directly from the toilet bowl without the odors permeating the room. The micro-vacuum pumps provide for a small package and the saddle having a direct connect to the vent stack utilizes the natural draw of the air in the vent stack.

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to various embodiments thereof, it will be apparent that modifications and variations are possible without departing from the scope of the invention which is defined in the appended claims.

What is claimed is:

1. A system for venting odors from a toilet bowl comprising:
   - a toilet having a bowl defining a headspace and having a plumbing connection to a vent stack;
   - a plurality of micro-vacuum pumps in fluid communication with the headspace of the bowl of the toilet and in fluid communication with the vent stack; and
   - a saddle that has an elongate seat having a plurality of tubular taps extending through the elongate seat at an orientation transverse to a longitudinal axis of the saddle, and a means for attaching the elongate seat to the vent stack;
   - wherein, when the saddle is mounted to the vent stack, each one of the plurality of tubular taps create fluid communication between an interior of the vent stack and a respective one or more of the plurality of micro-vacuum pumps.

2. The system of claim 1, wherein the plurality of tubular taps are equivalent in number to the number of the plurality of micro-vacuum pumps.

3. The system of claim 1, wherein the saddle comprises a sealing member seated about each of the plurality of tubular exhaust taps.

4. The system of claim 3, wherein the sealing member is an O-ring, V-ring, or X-ring seal.

5. The system of claim 3, wherein the sealing member is a rubber washer or a silicone seal.

6. The system of claim 1, wherein the saddle comprises a sealing member comprising a plurality of bores therethrough seated on an underside of the elongate seat, one bore corresponding to one each of the plurality of tubular taps.

7. The system of claim 1, wherein the elongate seat has a concave underside and extends at least 10 degrees along the circumference of the vent stack.

8. The system of claim 1, wherein each one of the plurality of tubular taps of the saddle comprises a quick connect fitting for connection to the respective one or more of the plurality of micro-vacuum pumps.

9. The system of claim 8, wherein the quick connect fitting is a slide lock fitting, a compression fitting, or a barbed nipple.

10. The system of claim 1, wherein the means for attaching the elongate seat to the vent stack comprises an annular adjustable clamp, a zip tie, an adhesive, or banded strapping.

11. The system of claim 10, wherein the annular adjustable clamp is present and comprises a clamp ring, t-bolt hose clamp, or double bonded plastic hose clamp.

12. The system of claim 1, wherein the plurality of micro-vacuum pumps are each in fluid communication with the headspace of the bowl by attachment to an underside of a toilet seat.

13. The system of claim 1, wherein the plurality of micro-vacuum pumps are each in fluid communication with the headspace of the bowl of the toilet via flexible tubing clamped to a rim of the toilet bowl.

14. The system of claim 1, wherein the plurality of micro-vacuum pumps are enclosed in a housing.

15. The system of claim 1, wherein the plurality of micro-vacuum pumps are each in fluid communication with the headspace of the bowl through a plurality of internal vacuum flow channels formed in the toilet bowl that each terminate with an air extraction port in an internal rim of the toilet bowl.

16. A kit for venting odors from a toilet bowl comprising:

a saddle comprising:

an elongate seat having a plurality of tubular taps extending through the elongate seat at an orientation transverse to a longitudinal axis of the saddle, and a means for attaching the elongate seat to a vent stack;

a plurality of micro-vacuum pumps connectable in fluid communication with a headspace of a toilet bowl and connectable in fluid communication with the saddle; and tubing sizable to lengths for connecting each one of the plurality of tubular taps to a respective one of the plurality of micro-vacuum pumps for fluid communication therebetween and for connecting each one of the plurality of micro-vacuum pumps to the headspace of the toilet bowl.

17. The kit of claim 16, wherein the plurality of micro-vacuum pumps are enclosed in a housing having dual connectors for each of the plurality of micro-vacuum pumps, wherein each of the dual connectors is connectable to the tubing.

18. The kit of claim 17, wherein the housing comprises an electrical connector in electrical communication with each of the plurality of micro-vacuum pumps, wherein the electrical connector is connectable to a power source.

19. The kit of claim 16, wherein the tubing comprises a main flexible tube having a plurality of smaller diameter tubes running an interior length of the main flexible tube.

20. The kit of claim 16, wherein the elongate seat has a concave underside and extends at least 10 degrees along the circumference of the vent stack.

* * * * *